United States Patent [19]

Huddle

[11] 4,034,772

[45] July 12, 1977

[54] VAULTED MEMBRANE SHELTER

[75] Inventor: Carl Frederick Huddle, Pleasant Ridge, Mich.

[73] Assignee: Tension Structures Co., Pleasant Ridge, Mich.

[21] Appl. No.: 597,970

[22] Filed: July 21, 1975

Related U.S. Application Data

[63] Continuation-in-part of Ser. No. 339,333, March 8, 1973, which is a continuation-in-part of Ser. No. 93,293, Nov. 27, 1970, abandoned.

[51] Int. Cl.[2] ..... A45F 1/12; A45F 1/16

[52] U.S. Cl. ..... 135/4 R; 135/3 E; 135/14 D; 135/15 CF; 135/DIG. 1

[58] Field of Search ..... 52/2, 63, 222; 135/1 R, 135/4 R, 15 CF, DIG. 1

[56] References Cited

U.S. PATENT DOCUMENTS

| | | | |
|---|---|---|---|
| 2,225,972 | 12/1940 | Brogren | 135/DIG. 1 X |
| 2,797,696 | 7/1957 | Fritsche | 135/1 R |
| 2,802,478 | 8/1957 | Fritsche | 135/DIG. 1 X |
| 2,806,477 | 9/1957 | Fritsche | 135/DIG. 1 X |
| 2,986,150 | 5/1961 | Torian | 135/1 R |
| 3,240,217 | 3/1966 | Bird et al. | 135/DIG. 1 X |
| 3,496,686 | 2/1970 | Bird | 135/DIG. 1 X |
| 3,534,750 | 10/1970 | Kolozsvary | 135/15 CF |
| 3,563,257 | 2/1971 | Cummins | 135/DIG. 1 X |
| 3,811,454 | 5/1974 | Huddle | 52/63 |
| 3,961,638 | 6/1976 | Huddle | 135/4 R |

*Primary Examiner*—Werner H. Schroeder
*Assistant Examiner*—Conrad L. Berman

[57] ABSTRACT

A vaulted membrane shelter comprising a multiplicity of vertical arches with curved bights, spaced apart, mounted on a base forming a frame that supports a flexible highly tensioned roof membrane operatively attached to the arches and curved concavely inward between them sufficiently to enhance its live roof load carrying capacity, to oppose arch deflection thereby increasing stability and to form a roof of double curvature to prevent membrane vibration and flutter. The membrane being tensioned longitudinally by arch separation movement which, in turn, tensions it transversely by slightly decreasing its inward curvature. Sufficient inward membrane curvature controls arch deflection within the elastic limits of membrane, similar to the way bicycle wheel spokes control deflection of the rim.

31 Claims, 19 Drawing Figures

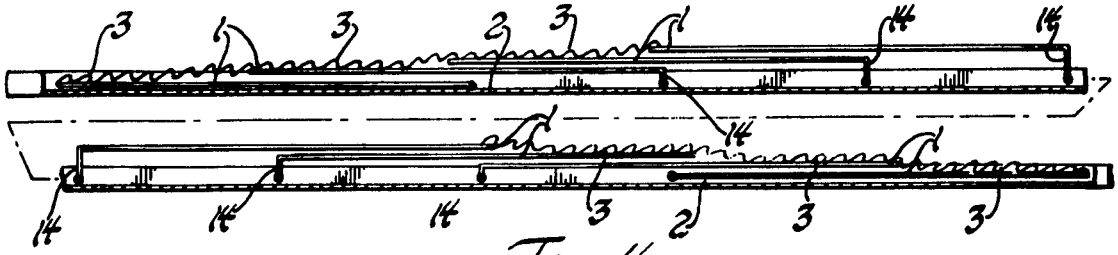
Fig. 4
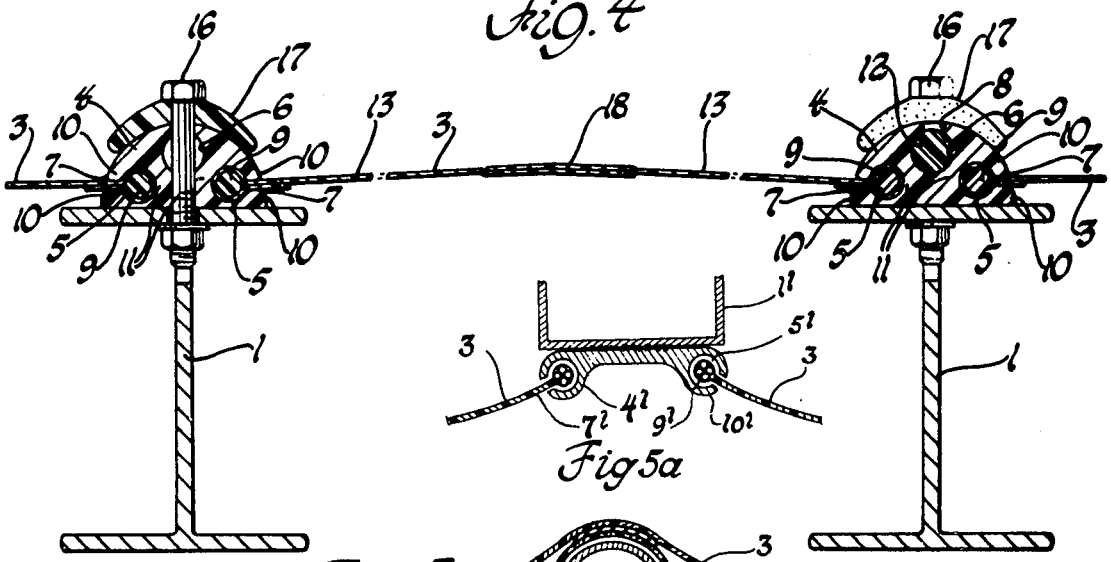
Fig 5a
Fig. 5
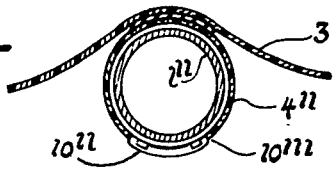
Fig. 5b
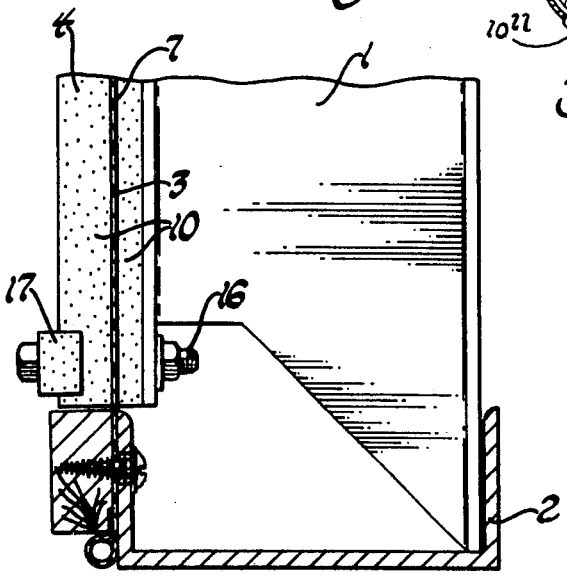
Fig. 6
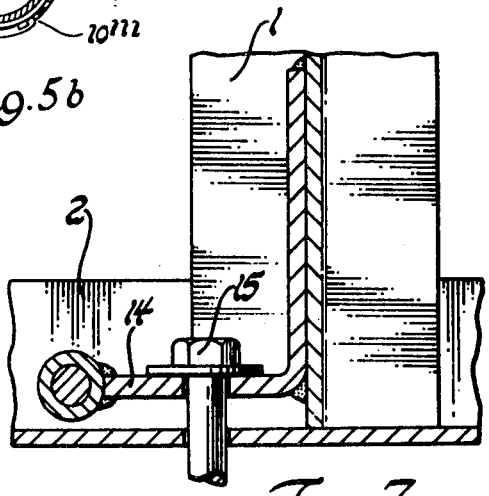
Fig. 7

VAULTED MEMBRANE SHELTER

BACKGROUND OF INVENTION

This is a continuation-in-part of my application Ser. No. 339,333 entitled, "A Vaulted Membrane Structure" filed Mar. 8, 1973 which is a continuation-in-part of my application Ser. No. 93,293 filed Nov. 27, 1970, now abandoned.

These applications are related to my arch supported shelter patents such as U.S. Pat. Nos. 3,215,153; 3,273,574; 3,820,553; 3,388,711; 3,856,029 and others that feature both inclined and vertical arch structures with highly tensioned membranes in double curvature.

SUMMARY OF INVENTION

The principal object of this invention is to provide a shelter of this type in which the tendency of the covering material and/or membrane to wrinkle and to flutter or vibrate in gusty or strong winds is minimized and the ability of the covering material to carry heavy loads of snow, ice and wind without undue stain is increased by sufficient curved depression of the tensioned covering material.

Another object of this invention is to provide a simplified membrane attachments to the arches which support it and an economical method to tension the membrane(s) between the arches.

Still another object of this invention is to provide a membrane that can be stretched over or between the arches, with the curvature between arches desired, and tensioned to the base to provide a practically wrinkle-free covering.

Another object of this invention is to provide sufficient sag or inward curvature between the arches of at least 5–10% of the distance between the arches. When the membrane is tensioned to a stiffened, wrinkle-free state, it will oppose deflection and movement of the arches and add great stability and resilent rigidity to the shelter.

Another object of this invention is to provide openings in the membrane side walls for ventilation, ingress-egress, etc., under tension rings embodied in the lower part of the membrane between arches, that can be easily opened or closed.

BRIEF DESCRIPTION OF THE DRAWING

FIG. 4 is a simplified schematic sketch of pivotal arches with offset hinges to move the arches apart in the erected position.

FIG. 5 shows a membrane attachment to the arches in the section 6—6 in FIG. 1.

FIG. 5*a* shows another membrane attachment to an arch suitable for small structures.

FIG. 5*b* illustrates a membrane attachment to an arch for a one piece cover or for large sections that span several arches.

FIG. 6 is a section at the base of lines 6—6 in FIG. 1.

FIG. 7 is a section at a right angle to FIG. 6 through the lower end of an arch.

DESCRIPTION OF THE PREFERRED EMBODIMENT

Figure 1:
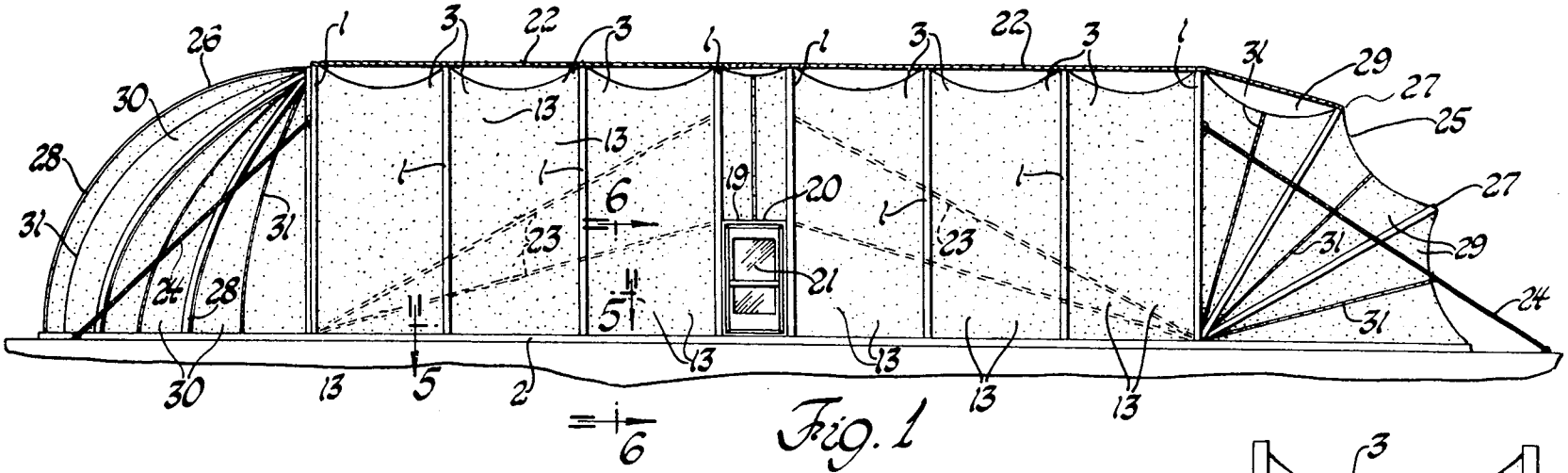
FIG. 1 is a side elevation of a vaulted structure in accordance with the invention.
Figure 2:
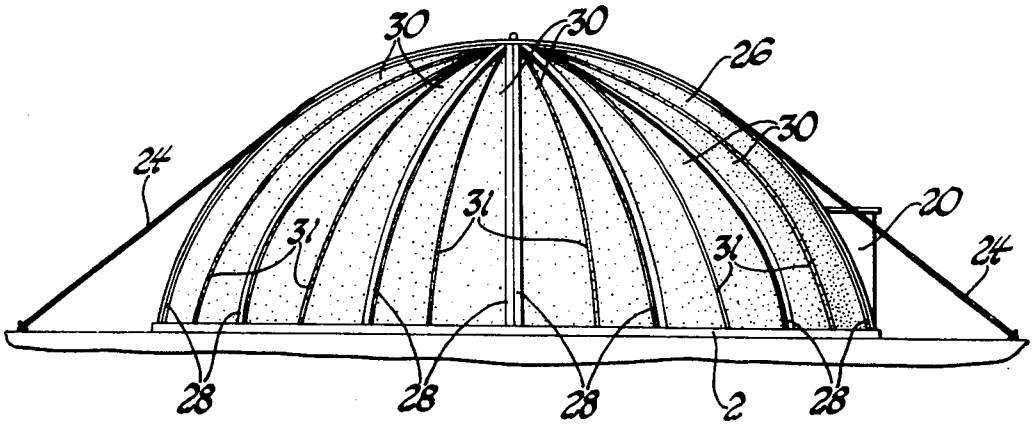
FIG. 2 is a left end elevation of FIG. 1.
Figure 8:
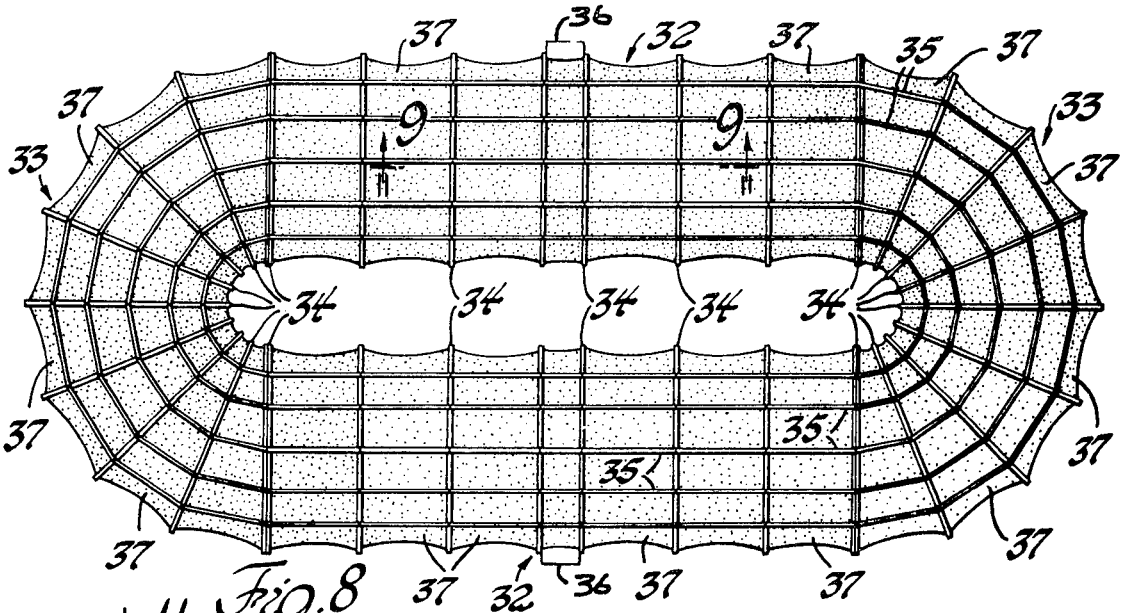
FIG. 8 is a top plan view of another shelter in accordance with the invention.

The vaulted structure shown in FIGS. 1 & 2 series of curved arches 1 mounted on the ground or other base 2 to serve as a frame to support a tensioned membrane 3 which extends between the arches and is operatively attached to them. The membrane usually consists of a suitable fabric, coated fabric or other flexible membrane material that is stretchable within limits and is selected to serve within its elastic limits.

When the shelter is made in modules the membrane 3 is usually made in panels that extend between the arches and is attached to them through the intermediary of a fastening means 4, 4' and 4'' such as shown in FIGS. 5, 5*a* J 5*b* respectfully.

This fastening means 5, and 4' consists of tunnel 5 and 5' in FIG. 5 and FIG. 5*a* respectfully, through which a beaded edge 9 and 9' of the membrane extends with the membrane emerging through a slit 7 and 7' in the tunnel wall respectfully. In the case of FIG. 5, the fastening means 10 is made of a fairly hard rubber type material so that the slots 7 can be opened to admit the beaded edge into the tunnels 5 when tunnel 6 is empty. After the beads 9 are inserted in the tunnels 5, a filler strip is inserted in the tunnel 6 that locks the lips 7 of tunnel 5 to retain the beaded edge in the tunnel 5.

The fastening means 4' shown in FIG. 5*a*, is usually made of metal with fixed tunnels 5' which can be extruded in the fastener or the arch. In this case, the beaded edges 9' must be inserted in the tunnels 5' by threading the beaded edge 9' in the tunnel 5' by sliding the membrane 3 in the slot 7' along the arch 1' or sliding the arch along the edge of the membrane. The fastener 4' can be fastened to the arch 1' by spot welding or metal fasteners. This fastener is used mostly for small structures where the arches and membranes to be attached are easy to handle.

The fastening means illustrated in FIG. 5*b* is adaptable when the membrane 3 is made in one piece or in large pieces that span several arches 1''. The membrane 3 fits over the arches 1'' and is usually attached to the arches 1'' by a fastening means 4'' that is in the form of a boot that enclosed the arch 1''. The lacing 10'' that holds boot together between grommets 10''', could be comparable to the lips 10 and 10' of the fasteners in FIG. 5 and FIG. 5*a*. The boot 4'' is welded or sewn to the cover 3. The boot 4'' is usually installed on the crown on the arches and extends over only 10–20% of the arch span.

The panels of the covering material are made in curved trough-shaped surfaces 13 to minimize the tendency of the material to flutter and vibrate in gusty winds and to enhance its ability to carry heavy loads of snow, ice and wind without undue strain. The maximum depression of the panels between the arches is preferably at least 5–10% of the distance between the arches.

The frame of arches 1 can be erected in various ways: by pivoting the arches on the base, with or without the membrane attached; by lifting each arch individually and fixing it in space by such means as the cables 22, 23 & 24, by pivotal raising or just lifting several arches, with or without the membrane attached, to their erected position; then fixing them in place by means of the cables 24, or purlins 35, or by means of the end closure 25 comprised of membranes 29 with arches 27 or the end closure 26 comprised of membranes 30 and semi-arches 28.

The arches 1 can be properly spaced by moving their ends apart on the base and spacing their summits by stretching the membranes 3 to a predetermined tension, or by the use of purlins, or the cable 22. The latter can act as a safety means to prevent collapse in case of membrane failure. In any case, the arches can be properly aligned in their upright position by guys 23 connected to the middle pair of arches and to the base 2. Guys 24 are connected to the outermost arches and to the base to hold the arches apart when the membrane 3 is tensioned or the guys 24 can also be used to pull the arches apart to tension the membrane above the base and to align the arches. Pulling down on the arches 27 in the end closure 25, on the right side of FIG. 1, can also tension the membrane 3.

Figure 3:
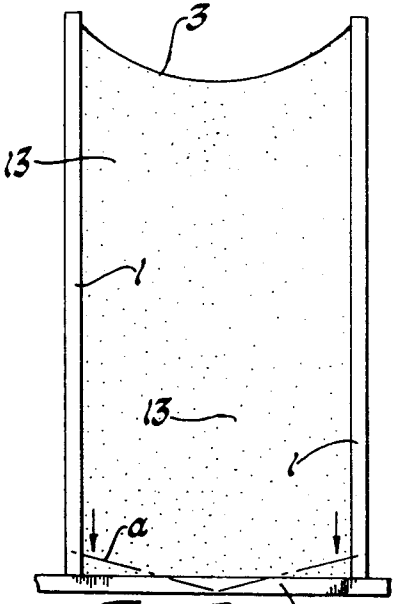
FIG. 3 illustrates one method of assembling the structure shown in FIG. 1 and 2.

To impart a wrinkle free trough-shape to the widths of covering material in some shelters, the following expedient can be employed instead of starting with exact preformed widths:

To start with, a width of covering material 3 of of nearly rectangular or other appropriate shape and of the length necessary to follow the contour of the arches 1 and with an inward curvature or trough shape having the proper width with beaded edges 9 is employed. This width is attached to a pair of arches 1 in the manner described. Then the edges of width are stretched to the extent necessary to make them of the same length as the periphery of the arches by drawing their ends down to the bottoms of the legs of the arches as diagrammatically indicated in FIG. 3 in which the broken line a indicates the disposition of the lower edge of the width before the lateral edges are stretched. This may be done either by pulling the lower ends of the edges of the width to the bottoms of the legs or by anchoring the lower ends of the edges and raising the bottoms of the legs. When the lateral edges of the width have been drawn down to the bottoms of the legs of the arches, they are clamped there by bolts 16 and jaws 17. The stretching operation is illustrated as it is in FIG. 3 primarily to facilitate and simplify illustration, but it may also actually be done while the arches are in upright positions as well as when they are in recumbent positions.

In somewhat larger or medium size structures, it is much easier to tension the lower portion of the panels 13 between the arches by stretching the panels toward the base by the use of tension rings as described in FIGS. 8–11. The membrane can continue under the tension ring to the base. A detachable arrangement is generally used so that the portion of the membrane below the tension ring may be raised to create an opening under the tension ring for egress, ventilation or both.

Suitable closures may be provided for one or both ends of the structure such as the accordion-like structures 25 and 26 shown in the drawing, which may be collapsed to open the ends. The closures 25 and 26 are generally similar in construction to the body of the structure in that they are made up of arches 27 in the case of the closure 25 and semi-arches 28 in the case of the closure 26 and widths 29 and 30 of flexible covering material which extend between and are attached to the arches. Membrane base rail 48 or to a sub-base. In some structures such as car parts or farm shelters it is not necessary to provide floor slabs or base rails as the arches can be separated manually and staked to the ground. The membrand 52 under the tension ring 53 may be omitted and the roof membrane may extend to the ground where it can be fastened continuously or intermittently to the ground or to a spacer, such as wood strut, between the ends of the arches 51.

The inward curvature between the arches 54 illustrates very well how the membrane captures the supporting arches 51 and 49 and opposes arch deflection. This allows the use of smaller arch cross-section and/or lower moment of inertia. The arches can be flexible like aircraft wings or automobile frames and still serve as a stable, safe and dependable support frame for the tensioned membranes.

Figure 13:
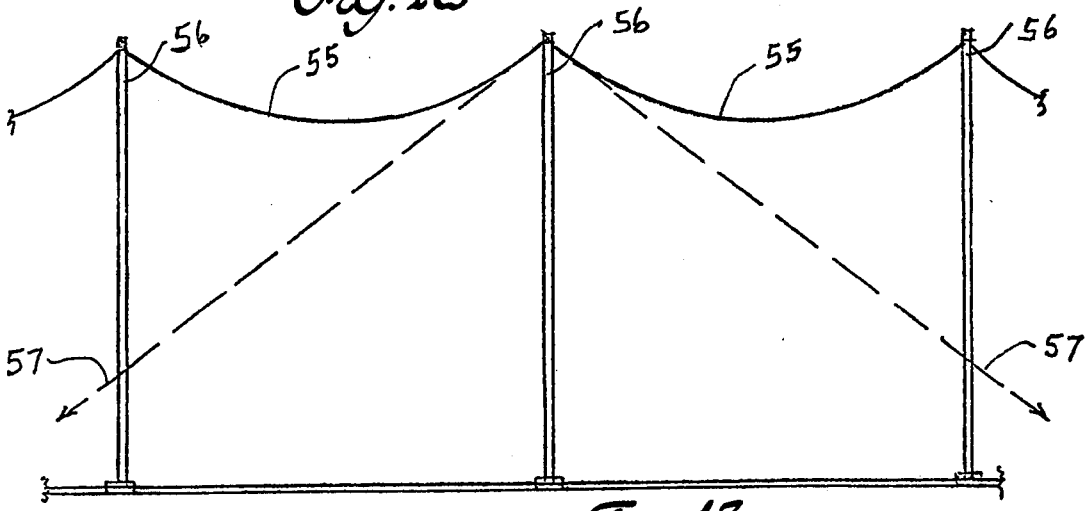
FIG. 13 is a schematic sketch illustrating the tangential pull of an inwardly curved membrane on a support arch.

FIG. 13 illustrates further how the membrane captures the arches if sufficient inward curvature is fabricated in the membrane 55 supported by the arches 56. The tangent line 57 indicates the line of force exerted by the tensioned membrane 55.

Figure 14:
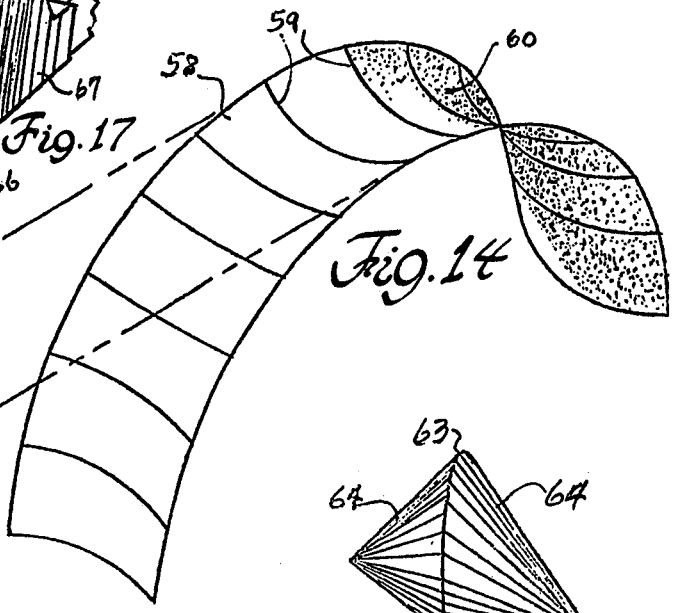
FIG. 14 schematically illustrates one method of fabricating an inward curvature in a roof membrane between support arches.

FIG. 14 illustrates one method of fabricating the inward curvature or trough shaped membrane between the support arches. Panels 58 are patterned in hour glass shapes, then fastened together 59 to form a trough 60. This trough can be varible from crown to the base or it can be always the same depth for economy or to meet required environmental conditions as the inward curvature enables the membrane to carry heavy live loads without undue stress and the double curvature opposes vibration and flutter of the membrane. The membrane panels 58 do not need to be cut or patterned in this shape but they must be fastened together with seams of this shape or otherwise to create the curved trough shape. FIG. 14 was included in the application Ser. No. 225,899 filed Feb. 14, 1972 in which it was shown as FIG. 16.

Figure 15:
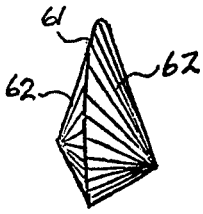
FIG. 15 schematically illustrates how an arch is "captured" by tension members much like spokes of a bicycle wheel captures the rim and prevents rim deflection.

FIG. 15 illustrates how an arch 61 would be captured by spokes 62 similar to a bicycle wheel with a wide hub.

Figure 16:
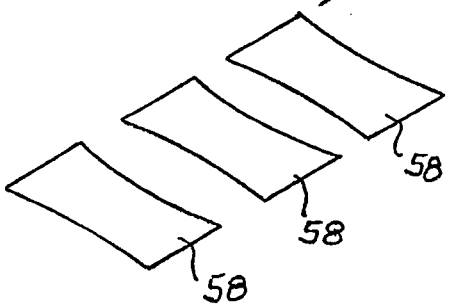
FIG. 16 schematically illustrates how tension members or a membrane captures the arch in these structures.
Figure 16:
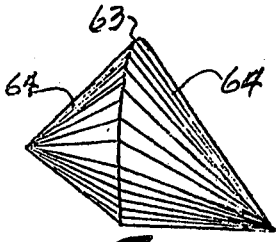

In FIG. 16 the same analogy is used to illustrate how the arch 63 is captured with spokes 64 that have a similar slope as the tangents 57 in FIG. 13. By assuming the components are the same in FIGS. 15 & 16, except for the length of the spokes, the arch in FIG. 16 has sacrificed some vertical stability but has gained some lateral stability and also gained ground area covered by the spokes. The comprise to provide sheltered are without sacrificing too much vertical stability is apparent.

Figure 17:
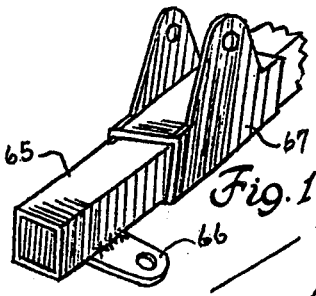
FIG. 17 illustrates a sub-base such as a base rail with a sliding arch attachment means.

In FIG. 17 illustrates a means whereby the arches can be mounted to swing and also moved toward and away from each other as stated previously. A base rail 65 can be anchored to a base or the ground by bolting or otherwise anchoring through the hole in plate 66 which is fastened to the base rail in a location that will not interfere with the movement of the arches to tension the membranes. The arch is pivotably attached to the component 67 which slides on and encompasses the base rail thus securing the arch to the base. Actually, once the shelter is erected and the membrane is anchored to the base, or a sub-base or base rail, the anchoring of the arch becomes only a positioning device as the strong membrane can keep the shelter from blowing away. The base rail 65 can be continuous or segmented. In smaller structures, the arches can be mounted directly on a base or non-sliding sub-bases.

However, the arches 27 of the closure 25 are mounted on the base 2 near the lower ends of one of the outermost arches 1 to swing about a horizontal axis upwardly to collapse the closure and open the end of the structure and downwardly to close it.

The summits of the semi-arches 28 of the closure 26, on the other hand, converge at the summit of the other outermost arch 1. The closure 26 is made in two halves which meet at a projection of the center line of the structure to close the end of the structure. The semi-arches are, however, mounted to swing about a vertical axis at the point of convergence of their summits to collapse each half against a leg of the end arch 1 and open the end of the structure.

Vaulted structures in accordance with my invention may be curvilinear of circular or ellipsoidal in shape instead of straight and include modules of different widths, shapes and materials.

Different means of attachment of the covering material to the arches and different methods of depressing and tensioning the flexible covering material between the arches may be also employed. A structure in which some of these and additional features are employed is illustrated in FIGS. 8–11.

The structure shown in FIGS. 8–11 is shaped like an ellipsoid or an elongated doughnut. It consists of two similar straight sections 32 disposed side by side with their ends interconnected by curved sections 33.

The sections 32 are similar in a general way to the body of the structure shown in FIGS. 1–7 and the sections 33 are also generally similar except in the arches 34 converge toward their inner sides and the modules are, therefore, frusto-triangular instead of rectangular in plan. The arches 34 are kept properly spaced by purline 35. An entry or entries 36 with door or doors in them may be provided in one or more of the modules.

The arches may or may not be mounted to swing on the ground or other base 2 but, in either event, they are mounted so that they may be moved toward and away from each other to facilitate the attachment of covering material 37 to the arches to align the arches 1 and, in some cases, to adjust the tension in the membrane 13.

Figure 10:
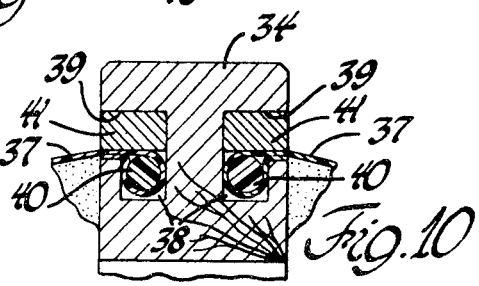
FIG. 10 is an enlarged view of the section of one of the arches shown in FIG. 9.
Figure 12:
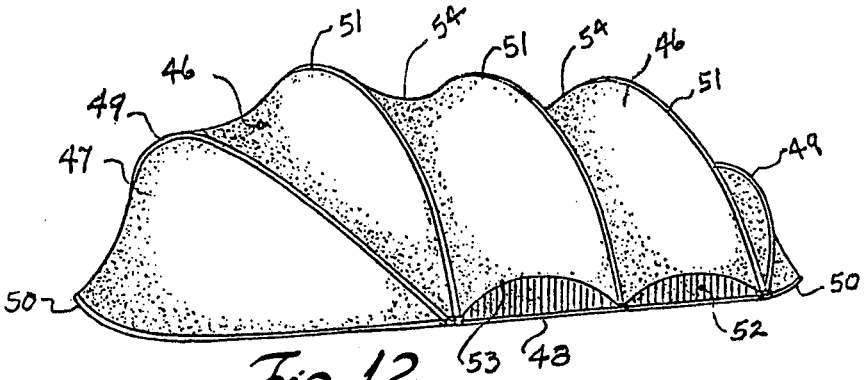
FIG. 12 is a thumbnail perspective of a typical small shelter of this specie.

The arches 1 & 34 may be made of curved laminated wood, metal, composites or other material. Another method of attaching the flexible membrane panels 37 to the arches is shown in FIG. 10, where there is provided in each side of the arches, a tunnel 38 into which extends a lock slot 39 through which the beads 40 on the edges of the widths 37 may be introduced into the tunnels. To hold the beads in the tunnels there are provided lock strips 41.

After the panels of covering material are attached to the arches and the arches are erected, one method of tensioning the panels is to move the arches apart sufficiently to tension the panels within their lower elastic limit. The cables 24 may be used to hold the arches apart or the end closures 25 & 26 with their respective arches and membranes can be used to hold the arches apart. The panels 3 are then pulled downward, toward the base 2 and attached to it to maintain the tension in the lower portion of the membrane.

In the panels 37 of covering material employed in the structure shown in FIGS. 8–11, a means to tension and depress the panels of covering material between the arches near the base, in large structures, there is provided, near the lower edges of the panels, one or more tension rings 42 of the type disclosed in my application entitled, "Prestressed Arch Supported Membrane Shelter," Ser. No. 336,228 filed Feb. 27, 1973 , now abandoned. Where tension rings are used there should be provided at least one tension ring for each surface 13. Each of these tension rings consists of a cable 43 which extends through an arches tunnel 44 embodied in or on the panel of covering material with its ends attached to the base 2 or to the ends of the arches 34. The cable may itself be a spring member or be attached to the base by a spring as shown in my application above identified.

Figure 9:
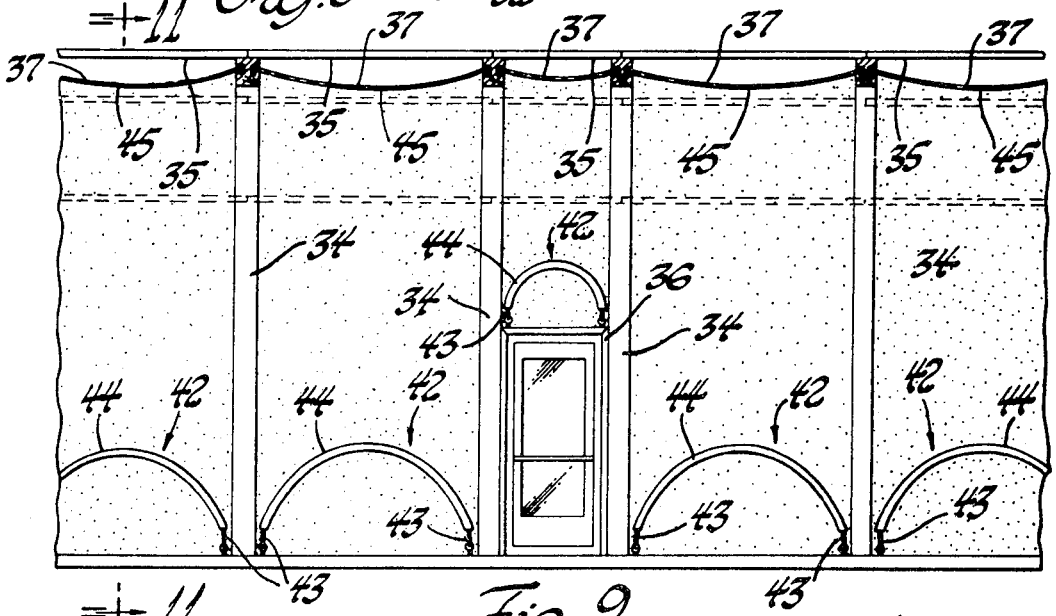
FIG. 9 is an enlarged view of the section line 9—9 of FIG. 8.
Figure 11:
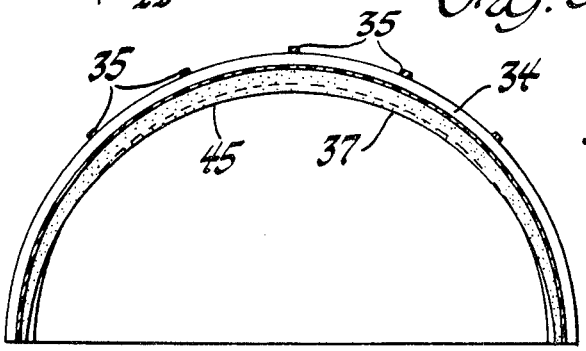
FIG. 11 is a view of the line 11—11 of FIG. 9.

In any event the cables 44 are tensioned sufficiently to draw the edges of the panels of covering material towards the base, tension the membrane widths with a depressed, intermediate portion of the panels as indicated at 45 in FIGS. 9 & 11. The curved depression can vary from crown to base, as desired, or load conditions dictate.

The roof membrane may be attached directly to the base without an inward depression along the base, if side snow loads, by drifting or piling, are below the membrane elastic limit. Above this area, the membrane curves transversely with the arches and inwardly between the arches longitudinally.

While such structures as this are classed as "tentage," these structures are as different from the popular tents of yesterday as day and night. Large tents were mad primarily of canvas that was dimensionally sensitive to humidity which made it a constant maintainance problem. It was also comparatively weak in tensile stress — usually around 50 lbs. per inch of width. In tents, these low strength membranes only served as the roof of the shelter that vibrated and galloped in high winds to destructive states. It contributed nothing to the horizontal stability of the tent.

The membranes available today have tensil strengths of up to 30 or more times the strength of the canvas used in the old tents, are reasonably stable in wide ranges of weather conditions and have much longer life expectancy. in these new structures, the curved membranes not only serve as strong roof and walls, but they contribute vital stability without vibration to the shelter. In intermediate and large structures, the horizontal movement of the arches apart from each other tensions the membrane longitudinally which, in turn, decreases the inward curvature of the membrane (to a pre-determined degree) which simultaneously tensions the membrane transversely. The degree of decrease in curvature depends on the fabric weave and the stretch due to tension. Wrinkle-free membranes, stiffened under high initial tension in a double curvature configuration within the lower range of their elastic limits, make these structures feasible and economical.

I claim:

1. A vaulted membrane shelter comprising at least two substantially vertical arches with curved bights mounted on a base, face to face, but spaced apart with their respective ends aligned to form a framework; a flexible roof membrane extending between, and being operatively attached to, said arches and said base that is tensioned longitudinally and transversely with an inward concave curvature between at least the bights of said arches, said inward curvature having been formed by said membrane having a longer circumferential length at where it is operatively attached to said arches then its circumferential length in a vertical plane midway between said arches; and means acting between at least one of said vertical arches and said base for fixing said arches apart to maintain tension in said membrane.

2. The vaulted shelter described in claim 1 except that said multiplicity of substantially vertical arches are spaced apart, with their respective ends nonaligned, in a frustotriangular relationship to form a curved framework for the shelter.

3. The shelter described in claim 1 wherein the means acting between said end vertical arches and said base to induce and maintain tension in said roof membrane is an end closure comprised of a least one semi-arch with a curved bight having one end attached to the crown of one of said vertical end arches and its other end attached to the base at a distance from the end of said vertical arch to which it is attached; a flexible membrane tensioned between and attached to said semi-arch and said vertical end arch that has a formed inward depression to provide a warped surface between said arches and means for anchoring said flexible membrane to the base.

4. The vaulted shelter described in claim 1 wherein the membrane is operatively attached to said arches includes a boot fixed to or embodied in said membrane that at least partially encloses the crowns of said arches.

5. The vaulted shelter described in claim 1 wherein said means acting between at least one vertical end arch and said base is a tensioned membrane.

6. The vaulted shelter described in claim 1 wherein the circumferential length of said membrane, where it is operatively attached to said arches, is at least 3% longer than its circumferential length in a vertical plane midway between said arches.

7. The vaulted shelter described in claim 1 wherein the inward concave curvature of the membrane between said arches has a maximum depth that is at least 5% of the distance between said arches.

8. The shelter described in claim 1 wherein said inward concave curvature of said membrane is such that a tangent to said curvature, drawn from where said membrane is operatvely attached to an arch, makes an angle less than 70° between said tangent and the plane of said arch.

9. The shelter described in claim 1 wherein said inward concave curvature of said membrane is comprised of "hour glass" shaped strips that extend lengthwise in a perpendicular relationship between said arches with their opposite ends fastened to corresponding locations on adjacent arches and their inwardly curving sides fastened to corresponding inwardly curving sides of the adjacent hour glass strips to form said inward curvature of said membrane between the bights of said arches.

10. The shelter described in claim 1 wherein said roof membrane that curves concavely inward between said arches is tensioned longitudinally between said arches which, in turn, slightly decreases the inward concave curvature as it tensions said membrane transversely between said arches to form a substantially wrinkle-free surface in double curvature between the bights of said arches.

11. The vaulted shelter described in claim 1 wherein said vertical arches are mounted on said base in parallel relationship.

12. The vaulted shelter described in claim 1 wherein said arches are segmented.

13. The vaulted shelter described in claim 1 wherein said arches are mounted on said base by use of a pivoting means.

14. The shelter described in claim 1 wherein said arches are mounted on said base by a means for permitting both pivotal and horizontal movement.

15. The shelter described in claim 1 wherein said vertical arches are semi-rigid, flexible arches that deflect, when supporting roof membrane loads, within their elastic limits.

16. The vaulted shelter described in claim 11 in which the means acting between said end arches and said base, to induce and maintain tension in said membrane, includes a tension member which is attached to and extends outward from said end arch and is attached to said base.

17. The vaulted shelter described in claim 16 wherein said tension member includes means for adjusting the tension in said membrane.

18. The vaulted shelter described in claim 1 wherein the means acting between said end arches and said base to maintain tension in said membrane is an end closure attached to an end vertical arch and anchored to said base.

19. The vaulted shelter described in claim 18 in which the end closure is comprised of at least one arch inclined outward from the center of the structure having its apex aligned with said vertical arches and its ends pivotably mounted in said base with each end being adjacent to the corresponding end of an adjacent vertical arch; a flexible membrane attached to and extending between said inclined arch and said vertical arch; means to anchor said inclined arch to said base to tension said membrane between said inclined arch and said vertical arch which also tensions the membranes between the crowns of said vertical arches.

20. The vaulted structure described in claim 19 in which the means to anchor said inclined arch to said base is a flexible membrane attached to and extending between said inclined arch and said base.

21. The vaulted structure described in claim 20 wherein the flexible membrane attached to and extending between said inclined arch and said base is attached to said base at least one tension ring with its ends attached to said base.

22. The vaulted shelter described in claim 20 except that said membrane attached to said inclined arch is also attached to a substantially prone arch and extends between them; said prone arch being anchored to said base.

23. The vaulted shelter described in claim 1 in which the means to fix the lower portion of said roof membrane in place is at least one tension ring comprised of an arch shaped pocket embodied in said membrane that is convexly curved upward above the base that contains a flexible tension member that has its ends attached to said base.

24. The vaulted shelter described in claim 23 wherein said roof membrane extends below said tension ring and is detachable from said base.

25. The vaulted shelter described in claim 23 except that the ends of said flexible tension member are attached to said adjacent arches.

26. The vaulted shelter described in claim 25 wherein said roof membrane extends below said tension ring and is detachable from said base.

27. The vaulted membrane shelter described in claim 21 wherein said vertical arches are limited in their spacing after membrane failure by at least one safety member extending between and attached to said arches.

28. The vaulted membrane shelter described in claim 27 in which the safety member is a tension member such as a cable.

29. The shelter described in claim 1 wherein said arches are mounted on said base by a means for permitting horizontal movement of the ends of said arches.

30. The shelter described in claim 29 wherein the means for permitting horizontal movement includes a base rail.

31. The shelter described in claim 30 wherein said base rail is noncontinuous.

* * * * *

UNITED STATES PATENT OFFICE

CERTIFICATE OF CORRECTION

Patent No. 4,034,772 Dated July 12, 1977

Inventor(s) Carl Frederick Huddle

It is certified that error appears in the above-identified patent and that said Letters Patent are hereby corrected as shown below:

Column 7, line 12, "than" should read --- then ---.

Signed and Sealed this

*First* Day of *August 1978*

[SEAL]

*Attest:*

RUTH C. MASON
*Attesting Officer*

DONALD W. BANNER
*Commissioner of Patents and Trademarks*

UNITED STATES PATENT OFFICE

CERTIFICATE OF CORRECTION

Patent No. 4,034,772 Dated July 12, 1977

Inventor(s) Carl Frederick Huddle

It is certified that error appears in the above-identified patent and that said Letters Patent are hereby corrected as shown below:

Column 1, line 12, "then" should read --than--.

This Certificate supersedes Certificate of Correction issued August 1, 1978.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,034,772

DATED : July 12, 1977

INVENTOR(S) : Carl Frederick Huddle

It is certified that error appears in the above-identified patent and that said Letters Patent are hereby corrected as shown below:

Column 7, line 12, "then" should read -- than --.

This Certificate supersedes Certificate of Correction issued August 1, 1978 and March 13, 1979.

Signed and Sealed this

*Twenty-seventh* Day of *May 1980*

[SEAL]

*Attest:*

SIDNEY A. DIAMOND

*Attesting Officer*

*Commissioner of Patents and Trademarks*

REEXAMINATION CERTIFICATE (346th)

United States Patent [19]

Huddle

[11] B1 4,034,772

[45] Certificate Issued * May 14, 1985

[54] VAULTED MEMBRANE SHELTER

[75] Inventor: Carl F. Huddle, Pleasant Ridge, Mich.

[73] Assignee: Tension Structures Co., Pleasant Ridge, Mich.

Reexamination Request:
No. 90/000,125, Dec. 14, 1981

Reexamination Certificate for:

| | |
|---|---|
| Patent No.: | **4,034,772** |
| Issued: | **Jul. 12, 1977** |
| Appl. No.: | **597,970** |
| Filed: | **Jul. 21, 1975** |

[ * ] Notice: The portion of the term of this patent subsequent to Jun. 9, 1993 has been disclaimed.

Certificate of Correction issued May 27, 1980.

Related U.S. Application Data

[63] Continuation-in-part of Ser. No. 339,333, Mar. 8, 1973, which is a continuation-in-part of Ser. No. 93,293, Nov. 27, 1970, abandoned.

[51] Int. Cl.[3] ..... A45F 1/12; A45F 1/16

[52] U.S. Cl. ..... 135/119; 135/102; 135/DIG. 1

[58] Field of Search ..... 52/2, 63, 222; 135/1 R, 135/4 R, 15 CF, DIG. 1, 102, 103, 119

[56] References Cited

PUBLICATIONS

"The Mark 66 Air Transportable Hangar" by Birdair Structures Inc. 1966.

*Primary Examiner*—J. Karl Bell

[57] ABSTRACT

A vaulted membrane shelter comprising a multiplicity of vertical arches with curved bights, spaced apart, mounted on a base forming a frame that supports a flexible highly tensioned roof membrane operatively attached to the arches and curved concavely inward between them sufficiently to enhance its live roof load carrying capacity, to oppose arch deflection thereby increasing stability and to form a roof of double curvature to prevent membrane vibration and flutter. The membrane being tensioned longitudinally by arch separation movement which, in turn, tensions it transversely by slightly decreasing its inward curvature. Sufficient inward membrane curvature controls arch deflection within the elastic limits of membrane, similar to the way bicycle wheel spokes control deflection of the rim.

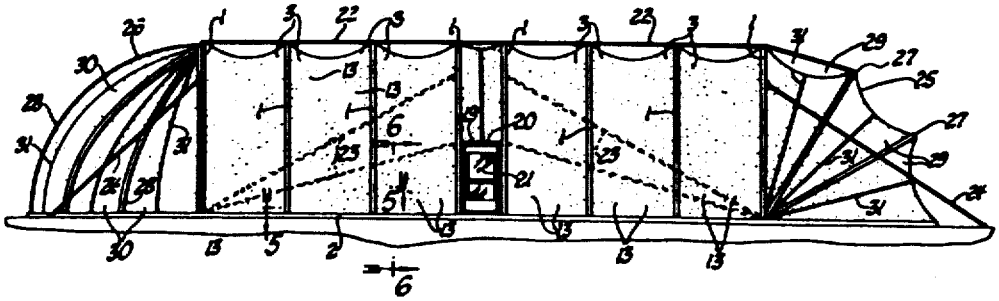

Fig. 6

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-31 is confirmed.

* * * * *